US010145187B2

(12) United States Patent
Magnuson

(10) Patent No.: US 10,145,187 B2
(45) Date of Patent: Dec. 4, 2018

(54) PIPE HANDLING METHODOLOGY

(71) Applicant: Nabors Drilling Technologies USA, Inc., Houston, TX (US)

(72) Inventor: Christopher Magnuson, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 3 days.

(21) Appl. No.: 15/368,990

(22) Filed: Dec. 5, 2016

(65) Prior Publication Data

US 2017/0167210 A1 Jun. 15, 2017

Related U.S. Application Data

(60) Provisional application No. 62/265,139, filed on Dec. 9, 2015.

(51) Int. Cl.
*E21B 19/14* (2006.01)

(52) U.S. Cl.
CPC ..... *E21B 19/14* (2013.01)

(58) Field of Classification Search
CPC ..... E21B 19/14; E21B 19/146; E21B 19/15; E21B 19/155; E21B 19/20
USPC ..... 414/22.51–22.71, 800
See application file for complete search history.

(56) References Cited

U.S. PATENT DOCUMENTS 1,804,962 A 5/1931 Thorpe
2,885,096 A * 5/1959 De Jarnett ..... E21B 19/02 414/22.68
2,946,464 A * 7/1960 Guier ..... E21B 19/14 414/22.68
3,592,347 A * 7/1971 Kelly ..... E21B 19/14 114/264
4,621,974 A * 11/1986 Krueger ..... E21B 19/20 211/70.4

(Continued)

FOREIGN PATENT DOCUMENTS

CA 2661631 A1 10/2010
CN 101798910 A 8/2010
CN 104389536 A 3/2015

OTHER PUBLICATIONS

Search Report and Written Opinion issued in Singapore Application No. 10201610374V dated Oct. 2, 2017, 8 pages.

*Primary Examiner* — Lynn E Schwenning
(74) *Attorney, Agent, or Firm* — Adolph Locklar

(57) ABSTRACT

A method for positioning a pipe stand in a fingerboard having fingers with a pipe racking apparatus includes gripping the pipe stand with an upper grabber and gripping the pipe stand with a lower grabber. The method also includes moving the pipe stand until it is aligned with a rack slot between two fingers of the fingerboard and extending the upper and lower grabbers to position the pipe stand in the rack slot. The method includes tilting the pipe stand in a first direction by moving one or both of the upper and lower grabbers in the first direction and tilting the pipe stand in a second direction. The method also includes lowering the pipe stand into contact with a setback of a drill floor, moving the pipe stand in the second direction until the pipe stand leans against the fingerboard, and releasing the pipe stand.

18 Claims, 9 Drawing Sheets

(56) References Cited

U.S. PATENT DOCUMENTS

| | | | | |
|---|---|---|---|---|
| 7,699,122 | B2 * | 4/2010 | Eriksen | E21B 19/14 175/52 |
| 2004/0057815 | A1 * | 3/2004 | Woolslayer | E21B 19/14 414/22.63 |
| 2006/0104747 | A1 | 5/2006 | Zahn et al. | |
| 2008/0164064 | A1 * | 7/2008 | Belik | E21B 19/14 175/52 |
| 2009/0257848 | A1 * | 10/2009 | Stroshein | E21B 19/14 414/22.65 |
| 2013/0330151 | A1 | 12/2013 | Orgeron | |
| 2014/0126979 | A1 * | 5/2014 | Hill | E21B 19/143 414/22.71 |

* cited by examiner

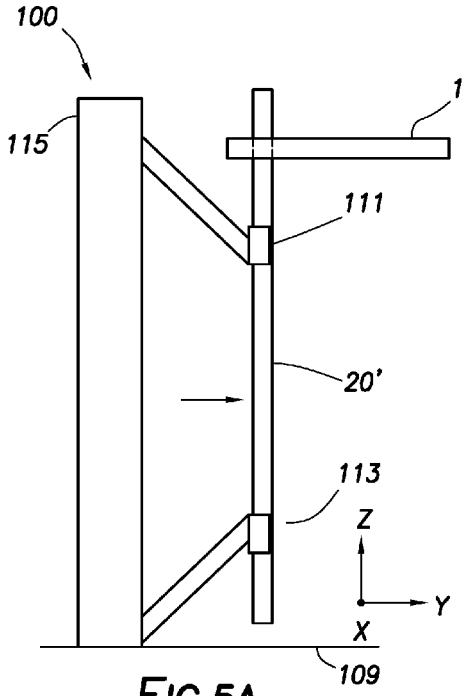
FIG.5A
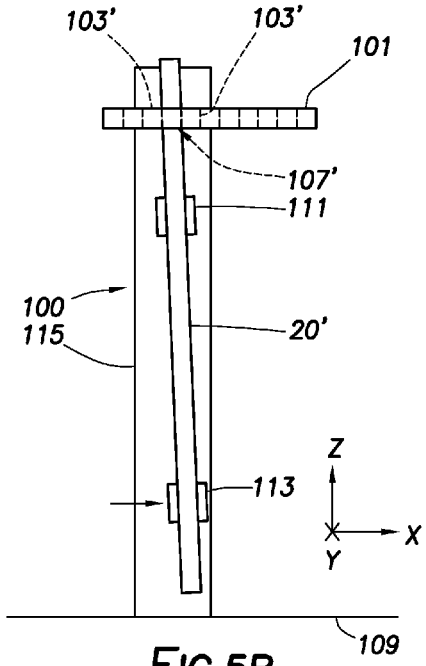
FIG.5B
FIG.5C
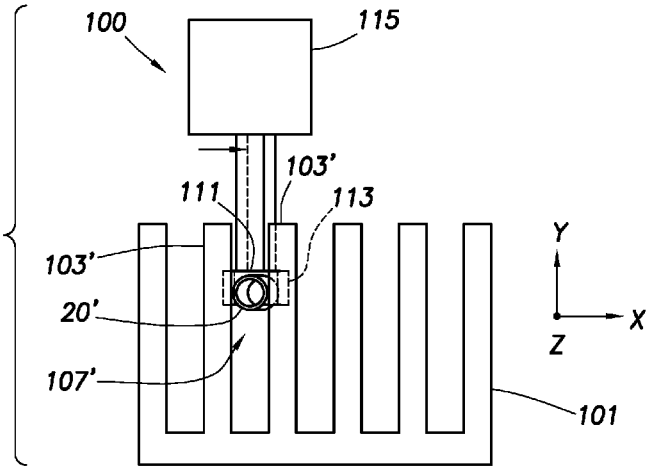

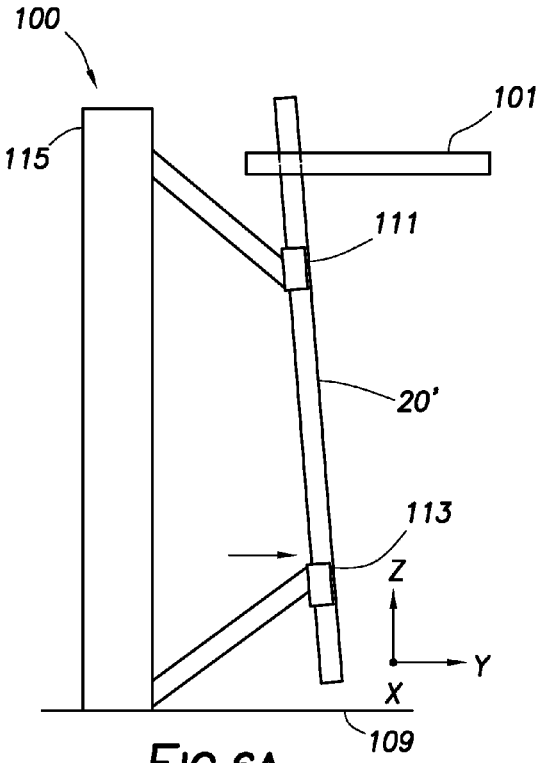
FIG.6A
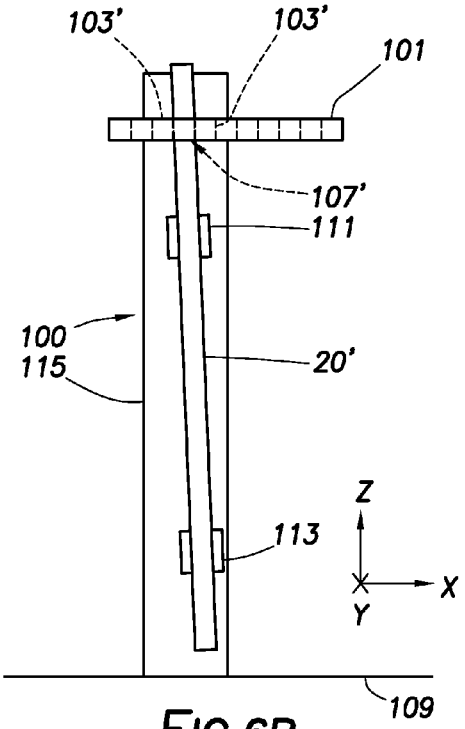
FIG.6B
FIG.6C
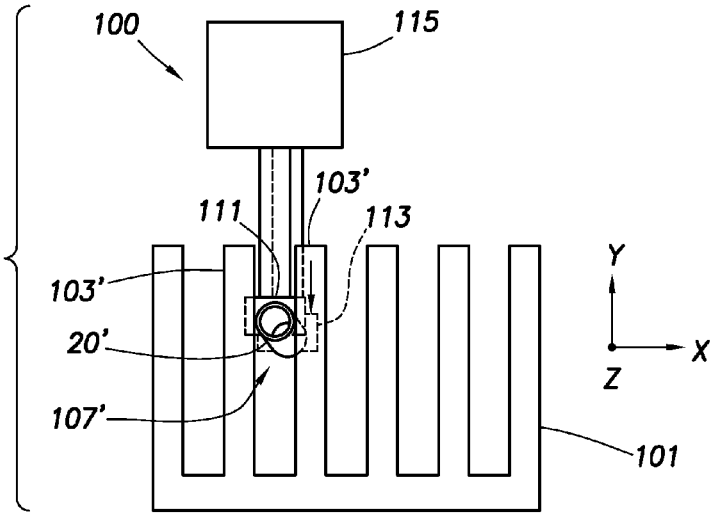

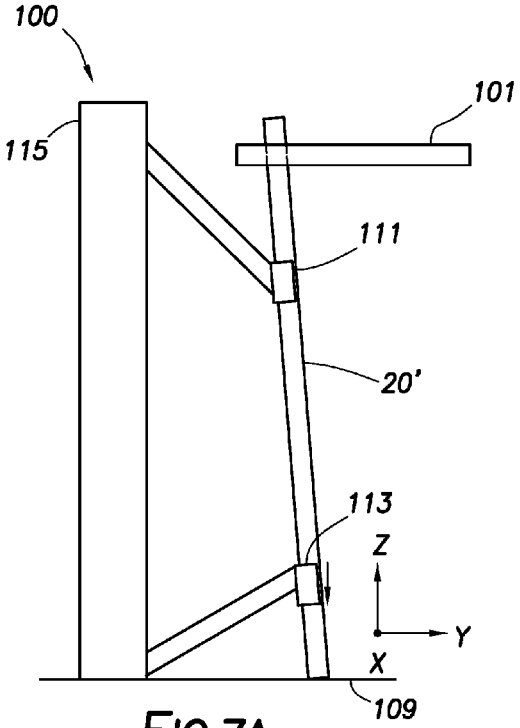
FIG.7A
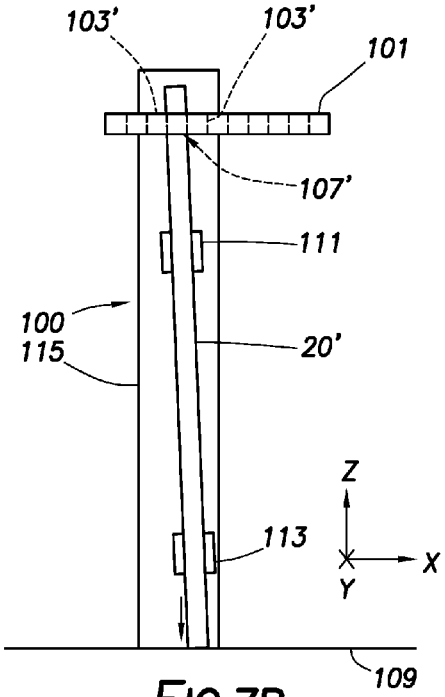
FIG.7B
FIG.7C
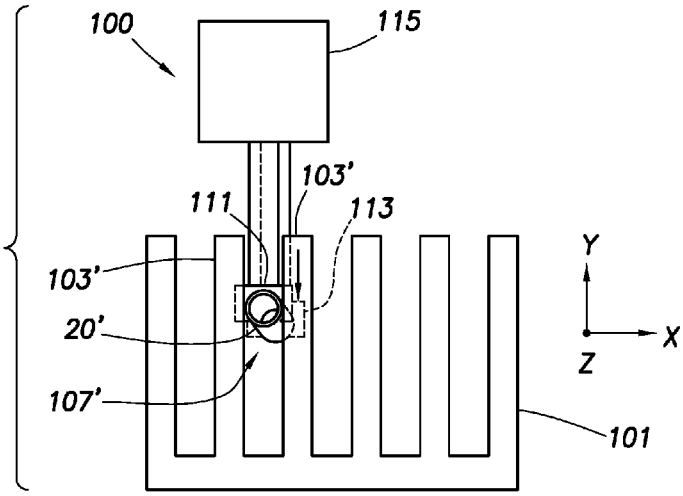

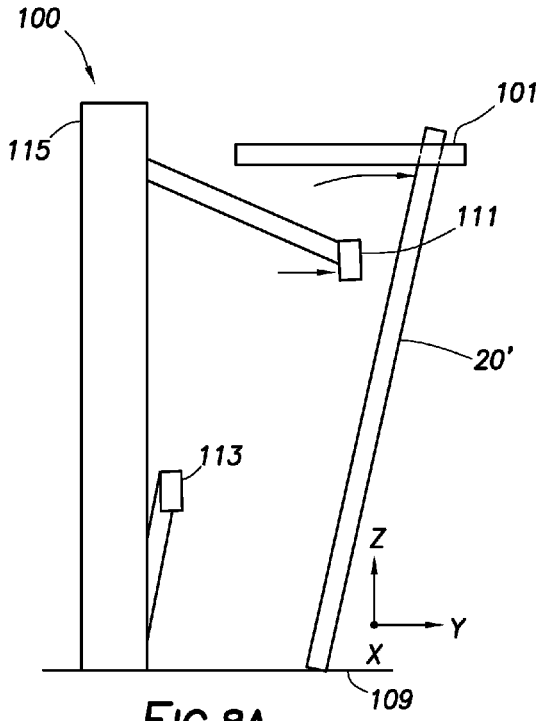
FIG.8A
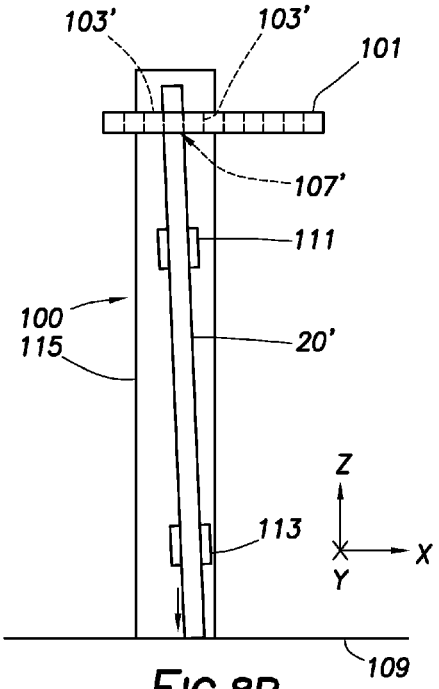
FIG.8B
FIG.8C
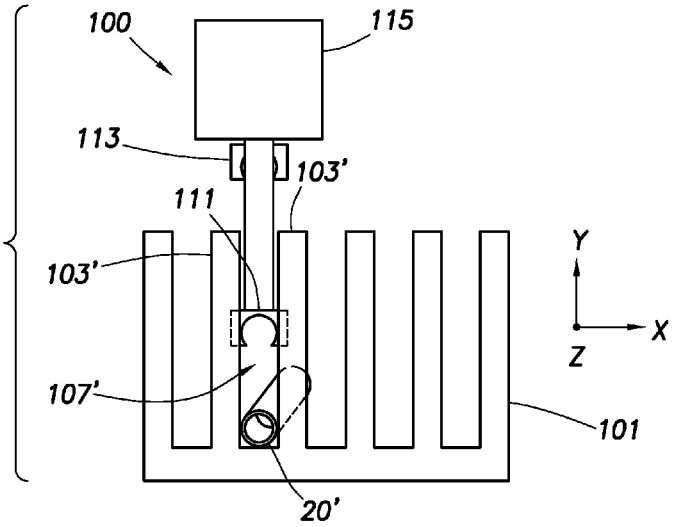

PIPE HANDLING METHODOLOGY

CROSS-REFERENCE TO RELATED APPLICATION

This application is a non-provisional application which claims priority from U.S. provisional application No. 62/265,139, filed Dec. 9, 2015.

TECHNICAL FIELD/FIELD OF THE DISCLOSURE

The present disclosure relates generally to methods for drilling rig equipment and specifically to methods of racking pipe stands on a drilling rig.

BACKGROUND OF THE DISCLOSURE

When drilling a wellbore, a drill string is extended from the drilling rig into the wellbore. The drill string includes a bit at its lowermost end. The drill string is typically formed from a plurality of end-to-end joined pipe sections. As the wellbore is drilled, additional lengths of drill pipe are added to the drill string to increase the length thereof. The additional lengths of drill pipe, typically sections of two or three individual drill pipes known collectively as a pipe stand, may be stored vertically on the drilling rig. The pipe stands are typically placed standing up on the drilling floor supported by fingerboards at an upper position. The fingerboards separate the stored pipe stands into rows, and prevent the pipe stands from falling over. Typically, the pipe stands lean towards the back of the fingerboard.

SUMMARY

The disclosure includes a method for positioning a pipe stand in a fingerboard having fingers with a pipe racking apparatus. The method includes gripping the pipe stand with an upper grabber of the pipe racking apparatus and gripping the pipe stand with a lower grabber of the pipe racking apparatus. The method also includes moving the pipe stand until it is aligned with a rack slot between two fingers of the fingerboard and extending the upper and lower grabbers to position the pipe stand in the rack slot. In addition, the method includes tilting the pipe stand in a first direction by moving one or both of the upper and lower grabbers in the first direction. The method also includes lowering the pipe stand into contact with a setback of a drill floor, moving the pipe stand in the second direction until the pipe stand leans against the fingerboard by a movement of the upper grabber, and releasing the pipe stand from the upper and lower grabbers.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 3A-8C depict a pipe racking operation consistent with at least one embodiment of the present disclosure.

DETAILED DESCRIPTION

Figure 1:
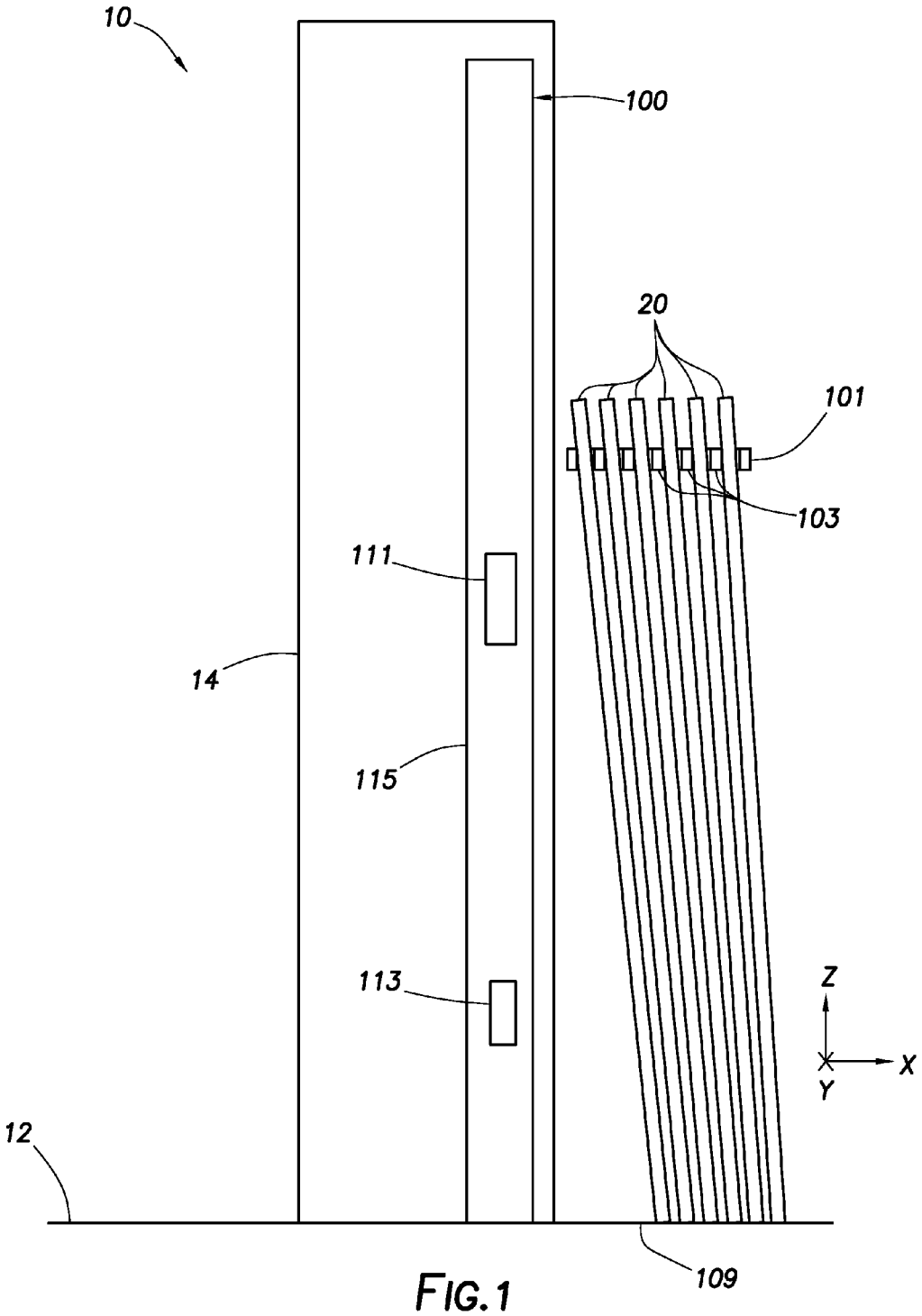
FIG. 1 depicts a side view of a drilling rig consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling rig 10 consistent with at least one embodiment of the present disclosure. Drilling rig 10 may include drill floor 12 and mast 14. Drilling rig may include pipe handling apparatus 100.

Figure 2:
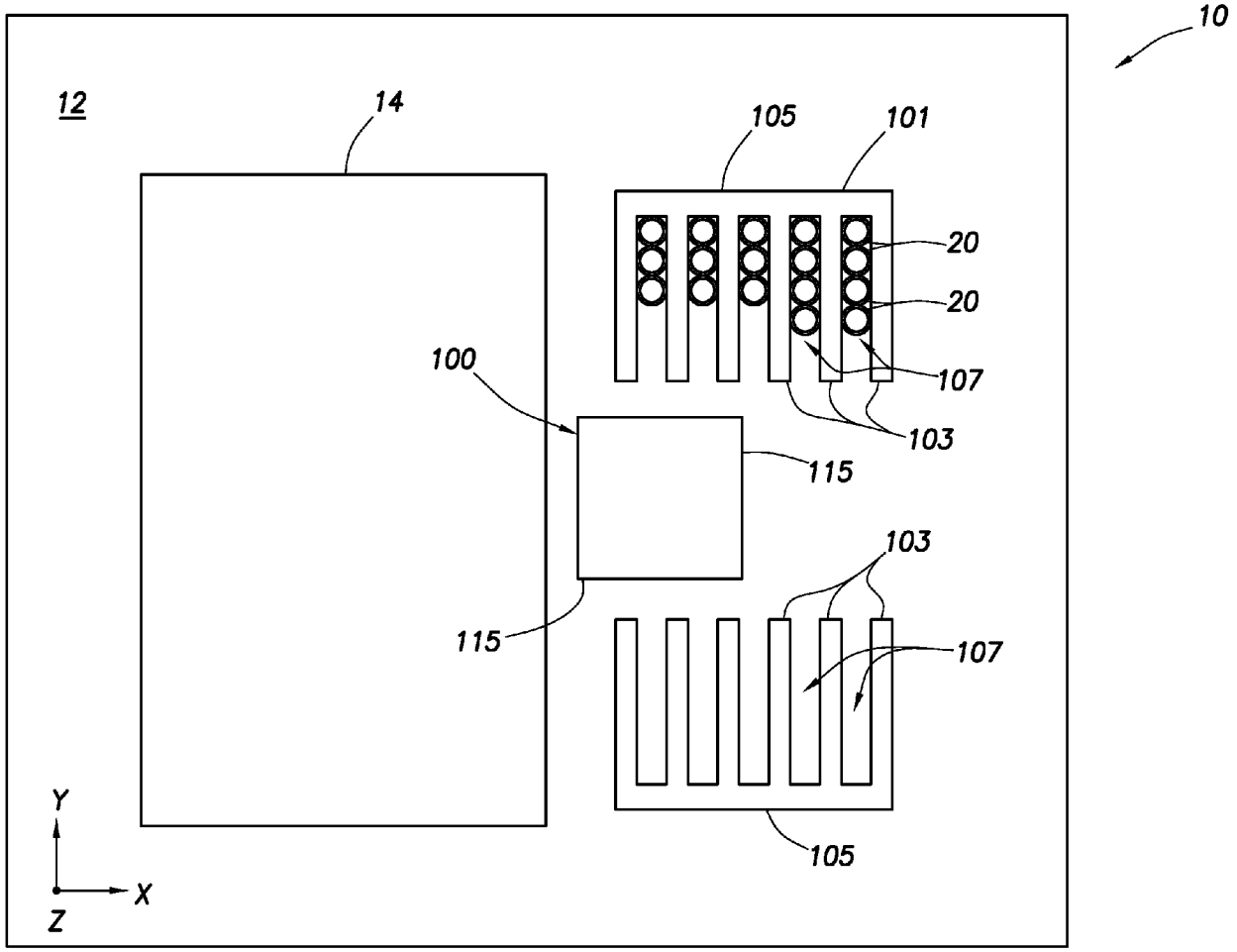
FIG. 2 depicts a top view of a drilling rig consistent with at least one embodiment of the present disclosure.

Drilling rig 10 may include fingerboard 101. Fingerboard 101 may, as depicted in FIG. 2, include fingers 103. Fingers 103 may extend parallel to each other from end plate 105 of fingerboard 101. Fingers 103 may define rack slots 107 which may receive pipe stands 20. Pipe stands 20 may, when stored in fingerboard 101, rest on setback 109 on drill floor 12. Pipe stands 20, as discussed herein below, may be placed into fingerboard 101 by pipe handling apparatus 100. The operations described herein may be undertaken during any drilling rig operation including, but not limited to, pipe stand preparation and tripping out of the wellbore. Pipe stands 20 may be placed into fingerboard 101 from a wellbore, mouse hole, v-door, slide, catwalk, or any other rig structure.

For the purposes of this disclosure, the following coordinate system will be used for the sake of clarity in the disclosure. The "X axis" or "X direction" is defined as extending horizontally in a direction perpendicular to fingers 103, the "Y axis" or "Y direction" is defined as extending horizontally in a direction parallel to fingers 103, and the "Z axis" or "Z direction" is defined as the vertical axis. For the purposes of this disclosure, movement along any of these axes or directions is to be understood to include some deviation from being perpendicular or perpendicular to fingers 103. For example, one having ordinary skill in the art with the benefit of this disclosure will understand that a movement within 10°-30° of these directions is considered a movement in the corresponding direction. These axes are marked on each of the accompanying figures. Although the operations described herein are described using this coordinate system, one having ordinary skill in the art with the benefit of this disclosure will understand that the specific placement of components of drilling rig 10 may vary without deviating from the scope of this disclosure. As depicted in FIG. 1, pipe stands 20 may be inclined along the X direction and along the Y direction as discussed further herein below.

In some embodiments, as depicted in FIG. 1, pipe handling apparatus 100 may include upper grabber 111 and lower grabber 113. Upper grabber 111 and lower grabber 113 may be extendable horizontally from pipe handling apparatus column 115. In some embodiments, upper grabber 111 may be movable vertically along pipe handling apparatus column 115. In some embodiments, pipe handling apparatus column 115 may be rotatable about the Z axis, such that upper grabber 111 and lower grabber 113 may be repositioned between mast 14 and fingerboards 101. Pipe handing apparatus column 115 may be movable along the X direction such that, for example and without limitation, upper grabber 111 and lower grabber 113 may be selectively aligned with a particular rack slot 107 as described further herein below.

FIGS. 3A-8C depict a racking operation consistent with at least one embodiment of the present disclosure. FIGS. 3A, 4A, 5A, 6A, 7A, and 8A depict a side view of drilling rig 10 viewed along the X axis. FIGS. 3B, 4B, 5B, 6B, 7B, and 8B depict a side view of drilling rig 10 viewed along the Y axis. FIGS. 3C, 4C, 5C, 6C, 7C, and 8C depict a top view of drilling rig 10.

Figure 3A:
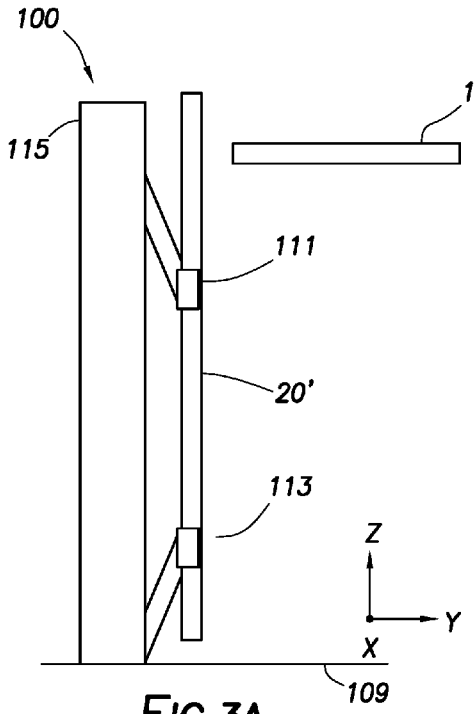
Figure 3B:
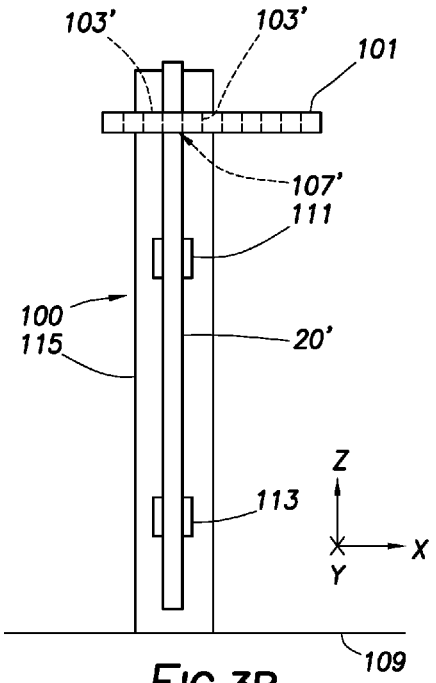
Figure 3C:
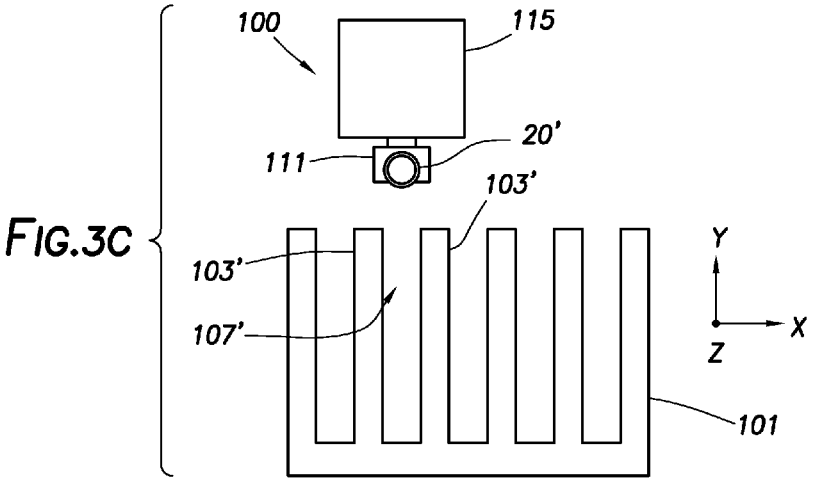

In operation, pipe stand 20', i.e. the pipe stand to be racked, may be lifted by pipe handling apparatus 100. In some embodiments, upper grabber 111 may grip pipe stand 20' and move vertically along the Z direction to lift pipe stand 20'. In some embodiments, lower grabber 113 may grip about pipe stand 20'. Pipe handling apparatus column 115 may rotate and move along the X direction until pipe stand 20' is aligned with rack slot 107', defined as the rack slot into which pipe stand 20' is to be placed, as depicted in FIGS. 3A-3C.

Figure 4A:
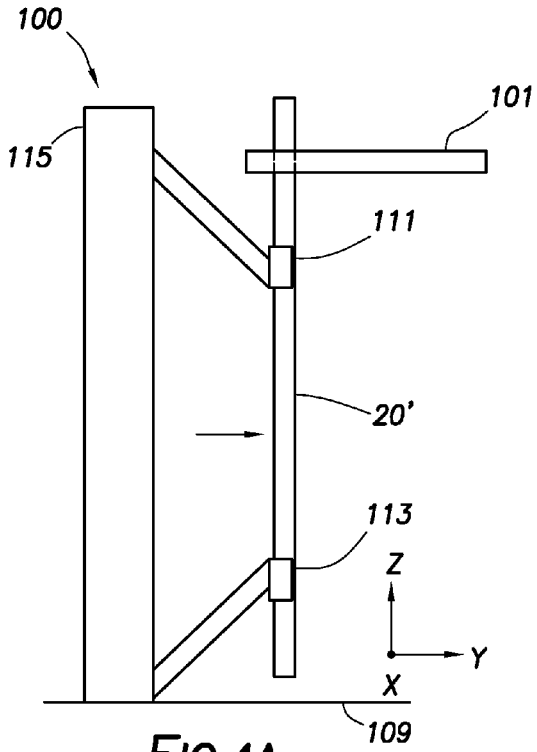
Figure 4B:
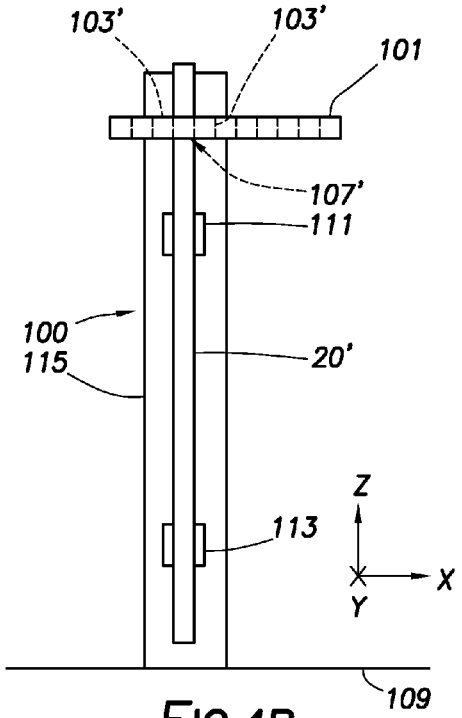
Figure 4C:
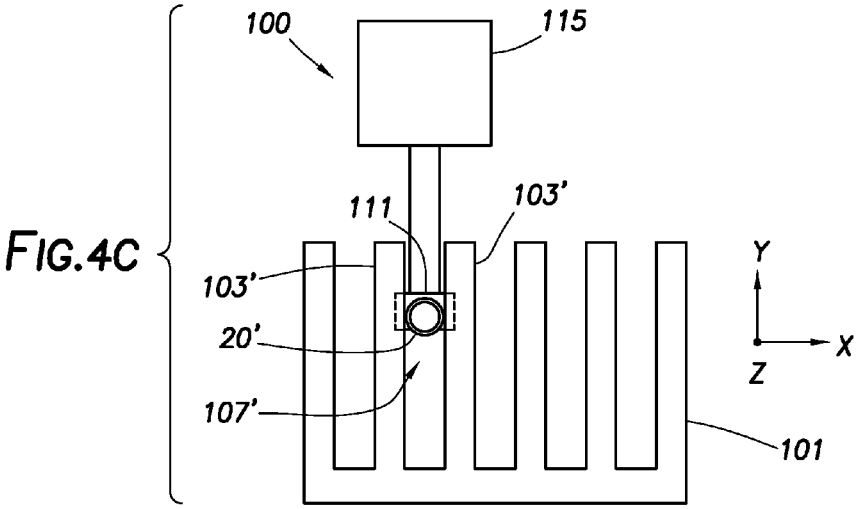

Upper grabber 111 and lower grabber 113 may extend along the Y direction as depicted in FIGS. 4A-4C. In some embodiments, upper grabber 111 and lower grabber 113 may extend such that pipe stand 20' extends between fingers 103' about half way into rack slot 107'. During this operation, upper grabber 111 and lower grabber 113 may maintain pipe stand 20' in a generally vertical orientation.

In some embodiments, a movement of one or more components of pipe handling apparatus 100 may, as depicted in FIGS. 5A-5C, tilt or lean pipe stand 20' in a first direction, here depicted as along the X direction. In some embodiments, the top of pipe stand 20' may tilt or lean in the positive X direction. In some embodiments, the top of pipe stand 20' may tilt or lean in the negative X direction. In some embodiments, the tilt or lean may be caused by a movement of the bottom of pipe stand 20' of between 0.5" and 10", between 1" and 5", or between 2.5" and 4.5". For example, one or more of upper grabber 111, lower grabber 113, or pipe handling apparatus column 115 may be moved horizontally along the X direction to introduce the tilt in pipe stand 20'. In some embodiments, one or both of upper grabber 111 and lower grabber 113 may be articulated such that they may rotate in response to the tilt in pipe stand 20'. In some embodiments, movement of one or more of upper grabber 111, lower grabber 113, or pipe handling apparatus column 115 may press the upper end of pipe stand 20' against fingerboard 101, causing the tilt in pipe stand 20'. In some embodiments, upper grabber 111 and lower grabber 113 may move separately along the X direction to introduce the tilt in pipe stand 20'.

In some embodiments, as depicted in FIGS. 6A-6C, lower grabber 113 may extend in a second direction, here depicted as a further movement in the Y direction, causing the base of pipe stand 20' to extend further from pipe handling apparatus column 115 along the Y direction. In some embodiments, the base of pipe stand 20' may be positioned adjacent to a base of another pipe stand (not shown) on setback 109 already placed into fingerboard 101. In some embodiments, upper grabber 111 may remain stationary while lower grabber 113 further extends, tilting pipe stand 20' along the Y direction. In some embodiments, pipe stand 20' may be tilted along the Y direction before being tilted along the X direction without deviating from the scope of this disclosure.

In some embodiments, as depicted in FIGS. 7A-7C, pipe stand 20' may be lowered such that the base of pipe stand 20' contacts setback 109, transferring the weight of pipe stand 20' to setback 109. In some embodiments, lower grabber 113 may release pipe stand 20'. In some embodiments, as depicted in FIGS. 8A-8C, upper grabber 111 may further extend along the Y direction until pipe stand 20' passes a substantially vertical position in the Y-Z plane, at which time upper grabber 111 may release pipe stand 20', allowing pipe stand 20' to contact fingerboard 101 and lean or tilt in the Y direction, allowing the weight of pipe stand 20' to hold it against fingerboard 101. Pipe stand 20' may thereby remain in fingerboard 101 by leaning thereagainst.

Figure 9:
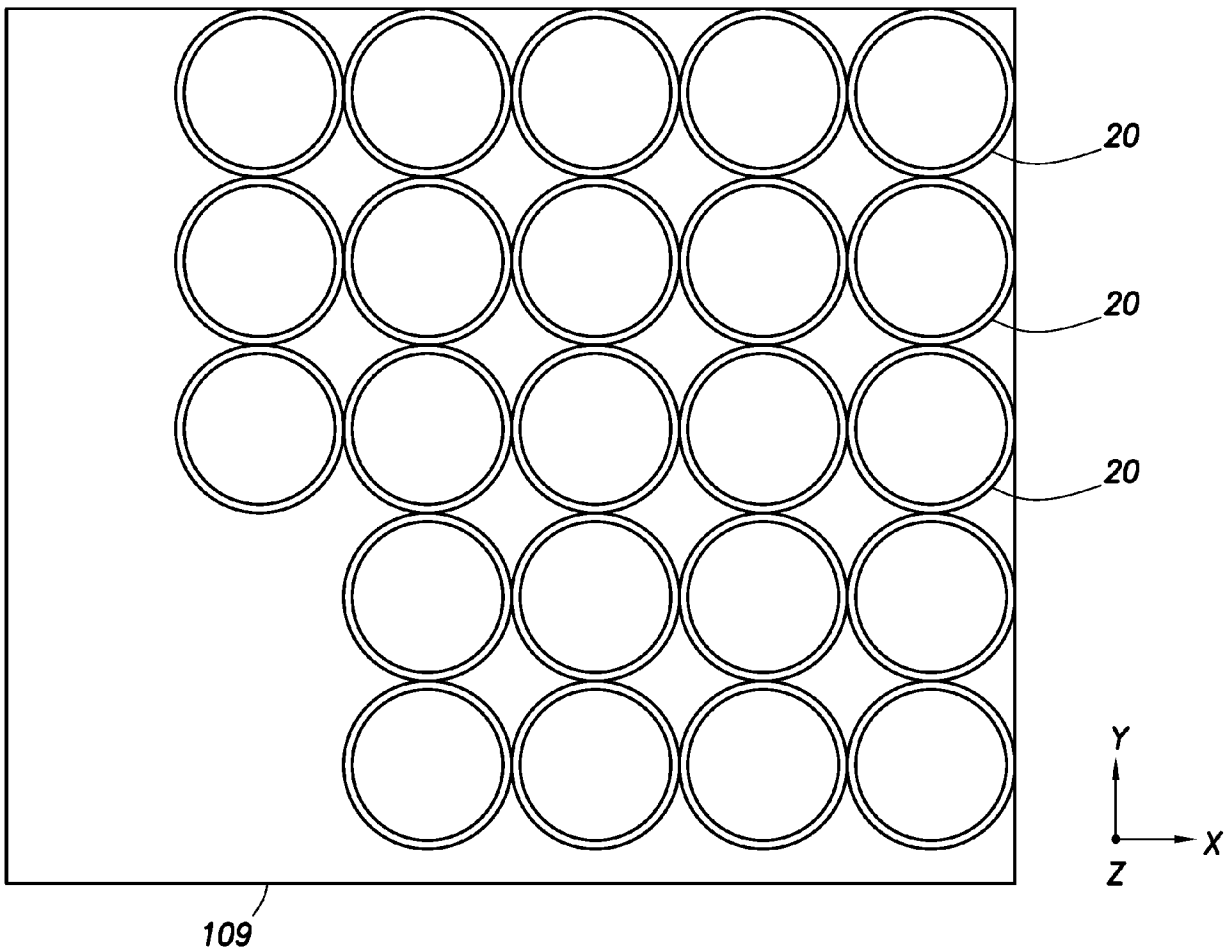
FIG. 9 depicts a setback consistent with at least one embodiment of the present disclosure.

These operations may be repeated for each additional pipe stand 20 desired to be placed in fingerboard 101 as depicted in FIG. 1. In some embodiments, by leaning each pipe stand 20 along both the X direction and Y direction, the bases of each pipe stand 20 may be in contact with adjacent pipe stands 20 in both the X and Y directions as depicted in FIG. 9, despite the separation between pipe stands 20 by the width of each finger 103 of fingerboard 101. Placing the bases of each pipe stand 20 in both the X and Y directions may allow, for example and without limitation, setback 109 to be smaller than if the bases of pipe stands 20 were not in contact. For example, in some embodiments, setback 109 may be narrowed by between 5" and 96", between 10" and 48", or between 12" and 36".

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method for positioning a pipe stand in a fingerboard having fingers with a pipe racking apparatus comprising:

gripping the pipe stand with an upper grabber of the pipe racking apparatus;

gripping the pipe stand with a lower grabber of the pipe racking apparatus;

moving the pipe stand until it is aligned with a rack slot between two fingers of the fingerboard;

extending the upper and lower grabbers to position the pipe stand in the rack slot;

tilting the pipe stand in a first direction by moving one or both of the upper and lower grabbers in the first direction, the first direction perpendicular to or parallel to the fingers of the fingerboard;

lowering the pipe stand into contact with a setback of a drill floor;

tilting the pipe stand in a second direction by moving the upper grabber in the second direction, the second direction substantially parallel or substantially perpendicular to the fingers of the fingerboard, the second direction substantially perpendicular to the first direction, until the pipe stand leans against the fingerboard by a movement of the upper grabber; and releasing the pipe stand from the upper and lower grabbers.

2. The method of claim 1, wherein a base of the pipe stand is in contact with at least one pipe stand in the first direction and at least one pipe stand in the second direction once the pipe stand is released from the upper and lower grabbers.

3. The method of claim 1 further comprising after gripping the pipe stand with the upper grabber and the lower grabber and before moving the pipe stand until it is aligned with a rack slot:

lifting the pipe stand vertically.

4. The method of claim 1, wherein the upper and lower grabbers are coupled to a pipe handling apparatus column.

5. The method of claim 4, wherein the step of moving the pipe stand until it is aligned with a rack slot comprises rotating the pipe handling apparatus column.

6. The method of claim 4, wherein the step of moving the pipe stand until it is aligned with a rack slot comprises moving the pipe handling apparatus column in a direction horizontal and perpendicular to the fingers (X direction).

7. The method of claim 6, wherein the step of extending the upper and lower grabbers to position the pipe stand in the rack slot comprises extending the upper and lower grabbers in a direction horizontal and parallel to the fingers (Y direction).

8. The method of claim 7, wherein the step of extending the upper and lower grabbers to position the pipe stand in the rack slot comprises maintaining the pipe stand in a generally vertical orientation.

9. The method of claim 7, wherein the step of tilting the pipe stand in the first direction comprises tilting the pipe stand in the X direction.

10. The method of claim 9, wherein the pipe stand has a bottom and wherein the step of tilting the pipe stand in the first direction comprises tilting a bottom of the pipe stand between 0.5" and 10".

11. The method of claim 9, wherein the step of tilting the pipe stand in the first direction comprises moving the upper grabber, the lower grabber, or a combination thereof in the X direction.

12. The method of claim 11, wherein the upper grabber, the lower grabber, or both are articulated, the step of tilting the pipe stand in the first direction further comprises rotating the upper grabber, the lower grabber or both.

13. The method of claim 9, wherein the step of tilting the pipe stand in the first direction comprises moving the upper grabber and the lower grabber separately along the X direction.

14. The method of claim 9, wherein the step of tilting the pipe stand in the second direction comprises tilting the pipe stand in the Y direction.

15. The method of claim 14, wherein the pipe stand is tilted in the X direction before being tilted in the Y direction.

16. The method of claim 1, wherein the step of lowering the pipe stand into contact with the setback of a drill floor comprises transferring the weight of the pipe stand to the setback.

17. The method of claim 1, wherein prior to the step of lowering the pipe stand into contact with a setback of the drill floor:

tilting the pipe stand in a second direction by moving the lower grabber in the second direction, the second direction substantially parallel or substantially perpendicular to the fingers of the fingerboard.

18. The method of claim 17, wherein the second direction is in a direction horizontal and parallel to the fingers.

* * * * *